US005253619A

United States Patent [19]

Richeson et al.

[11] Patent Number: 5,253,619

[45] Date of Patent: Oct. 19, 1993

[54] HYDRAULICALLY POWERED ACTUATOR WITH PNEUMATIC SPRING AND HYDRAULIC LATCHING

[75] Inventors: William E. Richeson; Frederick L. Erickson, both of Fort Wayne, Ind.

[73] Assignee: North American Philips Corporation, New York, N.Y.

[21] Appl. No.: 990,777

[22] Filed: Dec. 9, 1992

[51] Int. Cl.[5] ..... F01L 9/02

[52] U.S. Cl. ..... 123/90.12; 123/90.14; 123/90.15; 137/906; 251/30.01; 91/4 R; 91/417 R

[58] Field of Search ..... 123/90.11, 90.12, 90.13, 123/90.14, 90.15, 90.65; 137/906; 251/30.01; 91/4 R, 417 R

[56] References Cited

U.S. PATENT DOCUMENTS

| | | | |
|---|---|---|---|
| 2,490,823 | 12/1949 | Manning | 91/4 R |
| 4,187,884 | 2/1980 | Loveless | 137/906 |
| 4,589,627 | 5/1986 | Grotloh | 251/30.01 |
| 5,022,358 | 6/1991 | Richeson | 123/90.14 |
| 5,022,359 | 6/1991 | Erickson et al. | 123/90.14 |
| 5,058,538 | 10/1991 | Erickson et al. | 123/90.12 |
| 5,109,812 | 5/1992 | Erickson et al. | 123/90.14 |
| 5,152,260 | 10/1992 | Erickson et al. | 123/90.14 |
| 5,193,495 | 3/1993 | Wood, III | 123/90.14 |

FOREIGN PATENT DOCUMENTS 1195077 11/1985 U.S.S.R. ..... 91/4 R

*Primary Examiner*—E. Rollins Cross
*Assistant Examiner*—Weilun Lo
*Attorney, Agent, or Firm*—F. Brice Faller

[57] ABSTRACT

A hydraulic actuator includes a pneumatic piston, a hydraulic piston, and an engine valve on a common shaft. The pneumatic piston is urged between first and second stable positions primarily by a double acting pneumatic spring, with high pressure hydraulic fluid connected to a first hydraulic chamber being used to cock the hydraulic piston in a first stable position (engine valve closed). Hydraulic fluid isolated in a second hydraulic chamber is used to latch the hydraulic piston in a second stable position (engine valve open). Transfer of hydraulic fluid between first and second chambers is effected by a carrier for two check valves, which carrier in a first position disables the second check valve to permit fluid to flow from the second chamber to the first chamber, whereupon the first check valve closes (cocking). In a second position the carrier disables the first check valve to permit fluid to flow from the first chamber to the second chamber, whereupon the second check valve closes (latching). The carrier may be controlled directly by an EM actuator, or by hydraulic fluid channeled from a pilot valve which is EM actuated.

20 Claims, 11 Drawing Sheets

HYDRAULICALLY POWERED ACTUATOR WITH PNEUMATIC SPRING AND HYDRAULIC LATCHING

BACKGROUND OF THE INVENTION

The present invention relates to a bistable straight line motion actuator of a type suitable for actuating a poppet valve in an internal combustion engine. More particularly, the invention relates to an electronically controlled, hydraulically powered actuator which utilizes a pneumatic spring for energy recovery, and hydraulic latching.

A pneumatically powered actuator with hydraulic latching is disclosed in U.S. Pat. No. 5,022,359, which patent is incorporated herein by reference. This patent gives a thorough discussion of prior art actuators, particularly pneumatically powered actuators with energy recovery using compressed air. Virtually all of the prior art actuators discussed in the patent use some type of magnetic latching for holding the actuator in one of two stable positions.

U.S. Pat. No. 5,022,359 discloses a mechanism which uses a low air pressure (about 10 psi) to hold a working piston in its first stable position (engine valve closed). When a magnetic control valve is electronically switched, high air pressure (about 100 psi) drives the piston toward its second stable position compressing the air in front of it. This motion admits hydraulic fluid to an expansion chamber via a ball check. When the piston reaches its second stable position, the control valve has returned to its initial state, cutting off the air supply, and the compressed air behind the piston is released to atmosphere. The air in front of the piston is fully compressed, but the ball check closes and hydraulic fluid in the expansion chamber prevents motion back toward the first stable position, thereby maintaining the engine valve open. At the conclusion of the valve dwell, an electronically controlled magnetic plunger forces the ball check open, and the compressed air (stored potential energy) forces the piston back toward its first stable position. Air is compressed in front of the moving piston to dampen its motion, but this air is released just as the piston reaches its first stable position.

The actuator mechanism disclosed in U.S. Pat. No. 5,022,359 represents an improvement over the prior art insofar as propulsion air is used only to open the engine valve, and not to close it. The compressed air consumed is therefore decreased to about half the air consumed in prior pneumatically powered systems. However, two separately controlled magnetic mechanisms, one for the air control valve and one for the plunger to release the ball check, are required. Since the air control valve is rather large, a large electromagnetic latch is required. Further, due to the time required to pressurize the piston with air, after the control valve is switched, the response time is slow and not suited to use at high RPM.

U.S. application Ser. No. 07/878,644 filed May 5, 1992 discloses a fully symmetric pneumatically powered actuator wherein a working piston is pneumatically driven by opposed sources of compressed air in two opposed directions, and hydraulically latched in opposed stable positions by a two position hydraulic latch which is the sole electronically controlled component.

The latch is in effect a two-directional check valve which in each position admits fluid to a respective hydraulic chamber to prevent reverse movement of the working piston. When the check valve is electronically switched, hydraulic fluid passes between the two hydraulic chambers and the latch is released, permitting one of the sources of compressed air to drive the working piston as a working chamber behind the piston expands. As the piston moves, the source of compressed air connected to the expanding working chamber is cut off. Shortly after this, the compressed air expanding in the working chamber is exhausted through ports exposed by the piston. Meanwhile, air is compressed in a working chamber in front of the piston, which working chamber is connected to another source of compressed air in the final stage of movement. This provides damping for the piston without any additional loss of air or air pressure.

The two sources of compressed air are actually just cavities connected to a single source of air which replenishes air lost from an expanding working chamber through the exhaust ports after work is done. The small amount of make-up air is provided when each cavity is connected to its working chamber by action of the advancing piston.

The actuator according to this application is simpler than that disclosed in U.S. Pat. No. 5,022,359 insofar as only one electronically actuated magnetic latch is needed. Since this latch is only moving a low mass valve of the two-way check valve, the magnets are relatively small as compared to most prior art arrangements. Due to the low mass of the check valve, response times are relatively fast.

The two-way check valve provides for hydraulic latching in both stable positions, and at the same time permits a fast response. That is, in addition to the low mass, the high hydraulic pressures created during latching provide for a rapid commencement of movement when the check valve is reversed on electronic command.

While the need for compressed air has been reduced, a continuous supply of air is still required. Further, a rather complex cinching arrangement is required to assure that the engine valve is fully seated.

SUMMARY OF THE INVENTION

The actuator of the present invention differs from the prior art described above insofar as it is not pneumatically powered in the sense of requiring a continuous supply of compressed air. A pneumatic piston alternately compresses air in opposed first and second pneumatic chambers which serve as pneumatic springs to propel the piston in respective first and second directions, but there is no venting. Rather, high pressure hydraulic fluid is used to cock the hydraulic piston in its first stable position against a pneumatic spring force in the second direction, thus serving to overcome frictional losses in an otherwise pneumatically powered system. Hydraulic latching is used to hold the hydraulic piston in its second stable position against a pneumatic spring force in the first direction. Ideally no compressed air is needed, but small amounts are provided to the pneumatic chambers via check valves to make up for leakage.

The cocking of the pneumatic piston is effected by a hydraulic piston on a common shaft with the pneumatic piston and a first hydraulic chamber attached to a first source of hydraulic fluid (high pressure) for urging the hydraulic piston in the first direction. Latching of the piston in the second position (engine valve open) is effected by a second hydraulic chamber which receives hydraulic fluid as the hydraulic piston translates in the second direction, and a check valve which isolates the second chamber when fluid transfer is complete.

Transfer of hydraulic fluid between the first and second hydraulic chambers is accomplished by a pair of check valves on a reciprocable carrier which translates in first and second directions in response to an electronic signal. In a first position of the carrier, a first check valve is held open by moving fluid as the hydraulic piston moves in the first direction, and closes when the piston reaches the first stable position, a second check valve being held open (disabled) by the carrier. In a second position, the second check valve is held open by moving fluid as the piston moves in the second direction, and closes when the piston reaches the second stable position, the first check valve being held open (disabled) by the carrier.

The first check valve serves as a velocity sensor which provides only the amount of hydraulic fluid needed to cock the pneumatic piston in its first stable position. As it approaches that position, the fluid slows down until the first check valve closes. As the first check valve closes, it uncovers a port in the carrier which is connected to a second source of hydraulic fluid (low pressure). Since the second check valve is held open by the carrier in its first position, the second hydraulic chamber assumes the lower pressure of the second source. Since this port is closed when the carrier is in its second position, the closing of the second check valve isolates the second hydraulic chamber and latches the pistons (both hydraulic and pneumatic) in their second stable position (engine valve open).

The carrier may be powered by hydraulic fluid channeled by a pilot valve controlled by an electromagnetic (EM) actuator, or the carrier may be controlled directly by the EM actuator. According to an embodiment without a separate pilot valve, the first source of hydraulic fluid (high pressure) is cross-connected to a switching chamber which exerts hydraulic pressure urging the second check valve closed. The second hydraulic chamber is cross-connected to a switching chamber which exerts hydraulic pressure urging the first check valve closed. This switching chamber will have high pressure fluid when the carrier is in its second stable position. That is, it will then be exposed to the pressure of the hydraulic fluid latching the hydraulic piston in its second stable position. The additional switching pressure provided by the hydraulic cross-connects compensates for the mass of the carrier which must be shifted by the EM actuator.

According to a further embodiment the size of the spring chambers is varied so that the pneumatic force and the travel of the pneumatic piston can be varied. This in turn limits the travel of an engine valve fixed on the shaft, and provides a system for variable valve lift. The concept may be implemented by an additional piston defining one end of the first pneumatic chamber, the position of the additional piston being pneumatically controlled in common with other actuators in the intake or exhaust valve train.

According to a further variable lift embodiment, the hydraulic piston is in two parts separated by a column of hydraulic fluid. In a first mode (maximum lift) the column has a fixed volume so that the two parts behave as a single piston. In a second mode (minimum lift) fluid is transferred out of the column through an open valve as the hydraulic piston part travels in the second direction, until the part closes a port and forces the column to move a second part attached to the engine valve. The return motion of the pneumatic piston re-admits hydraulic fluid to the column, resulting in a "lost motion" between the two piston parts.

The actuator may advantageously be incorporated in a module having an extension for reception in a profiled bore in the head of an internal combustion engine. Repair may thus be effected by replacing a module, so that down time for an automobile is minimized.

DETAILED DESCRIPTION OF THE PREFERRED EMBODIMENTS

Figure 1:
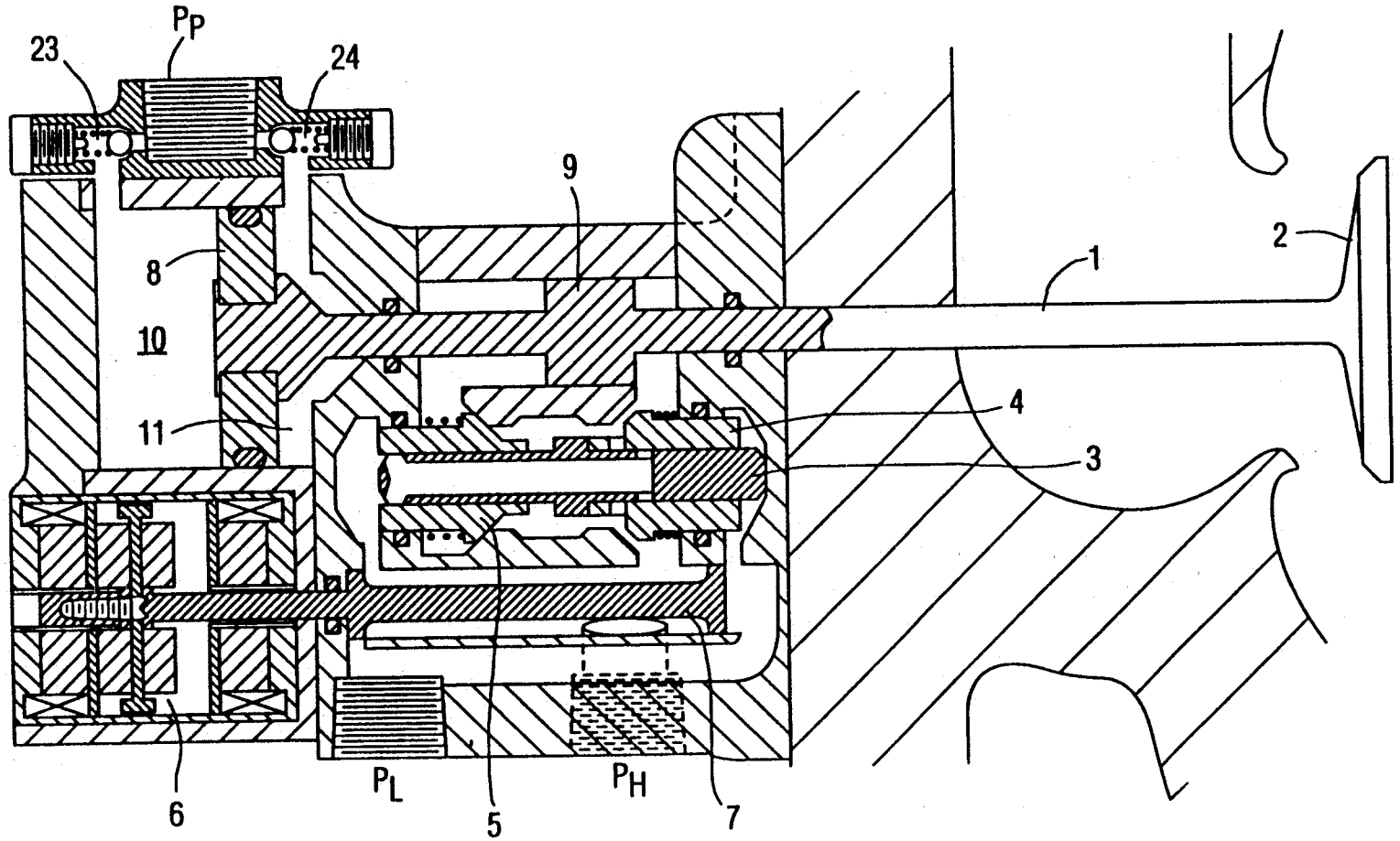
FIG. 1 is a section view of the actuator assembly prior to initialization.

The poppet valve actuator as illustrated in FIG. 1 depicts the actuator before it is initialized. Several of its important component parts consist of a dual position shaft 1 which connects to the poppet valve 2, a two position electromagnetic actuator 6, which is used to shift the pilot valve 7 back and forth and a multi-position valve assembly consisting of a carrier 3 and two check valves 4 and 5. The dual position shaft 1 consists of a pneumatic piston 8 and a hydraulic piston 9 which work in conjunction with each other to operate the poppet valve. A unique method of controlling the motion of these pistons by means of the sequenced control valves will be elaborated on in detail in this section.

FIG. 1 illustrates the actuator as it may appear when not in use. Before the actuator can be used, a series of preparatory events must be completed before the unit is fully initialized and ready to accept valve opening and closing commands. The main shaft 1 appears holding the poppet valve 2 open while the other valves are randomly disposed and must be positioned to be compatible with the initialization requirements. With all hydraulic pressure shut off to the actuator, the first event will be to pressurize port $P_P$ with 20 psi air pressure. The orifices in ball checks 23, and 24 to chambers 10 and are sized to position the piston 8 approximately as shown.

Figure 2:
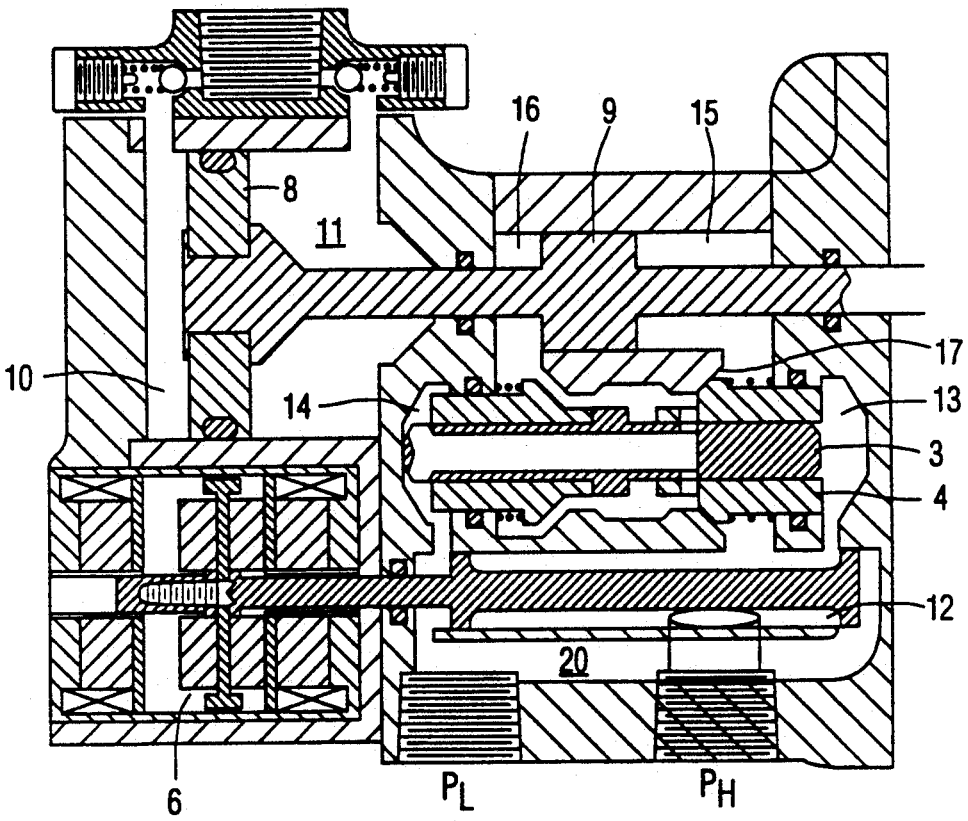
FIG. 2 is a section view of the actuator fully initialized, with the pilot valve and engine valve in their first stable positions.

Referring now to FIG. 2, after pressurizing the chambers 10 and 11, two more operations are required to initialize the actuator. First the electromagnet actuator 6 and its associated pilot valve 7 are powered to the right. Then high pressure hydraulic fluid is injected into the valve chambers 12, 13, and 15 through port $P_H$. As this pressurized fluid enters the pilot valve cavity 12 it continues into chamber 13 where it immediately powers carrier 3 to the left, and it also enters first latching chamber 15, wherein it powers piston 9 to the left. Note that chambers 12 and 15 are connected around check valve 4. Since check valve 4 is spring loaded against the valve seat 17, the fluid in chambers 12 and 15 cannot escape and thus can provide full thrust to drive piston 9 all the way to the left. As piston 9 moves to the left, it also powers the pneumatic piston 8 to the left which results in compressing the air in chamber 10. The actuator is now fully initialized with high pneumatic pressure in chamber 10 being held in position as an air spring by the hydraulic fluid against piston 9 in chamber 15. Note that the fluid pressure on the left side of piston 9 is vented out through port 18 in valve 4 and port 19 in the carrier 3, which are now aligned, and then on out through chamber 14 and 20 into port $P_L$. This low pressure path to the low pressure side of the hydraulic system assures that the hydraulic piston 9 can exert the full force of the hydraulic pressure in chamber 15.

Figure 3:
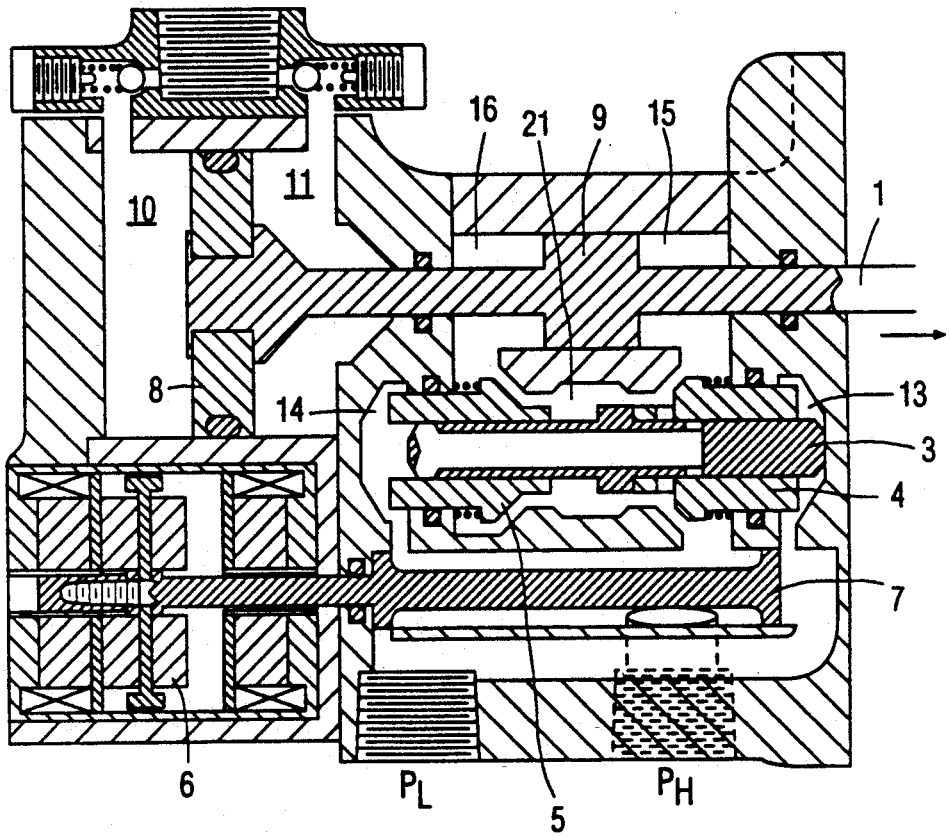
FIG. 3 is a section view of the actuator after the pilot valve moves to its second stable position, as the main valve is moving from its first to its second stable positions.

FIG. 3 shows the EM actuator 6 energized to move the pilot valve 7 to the left, which causes the high pressure fluid from $P_H$ to enter chamber 14. This pressure moves carrier 3 to the right which forces one way valve 4 to open by bearing against an annular shoulder thereon. The high pressure fluid in chamber 15 now bypasses around piston 9 through transfer passage 21 into second latching chamber 16 while forcing its way past valve 5, which acts as a check valve. This allows the hydraulic pressure to be equal on both sides of piston 9, which cancels the initial holding force and allows the pneumatic piston 8 to accelerate to the right under the compression force of the air in chamber 10.

By the time the dual piston shaft 1 reaches the midway position both valves 4 and 5 are wide open (springs compressed) to allow the hydraulic fluid to rapidly travel from the volume in front of the advancing piston 9 around to the volume behind the traveling piston.

Figure 4:
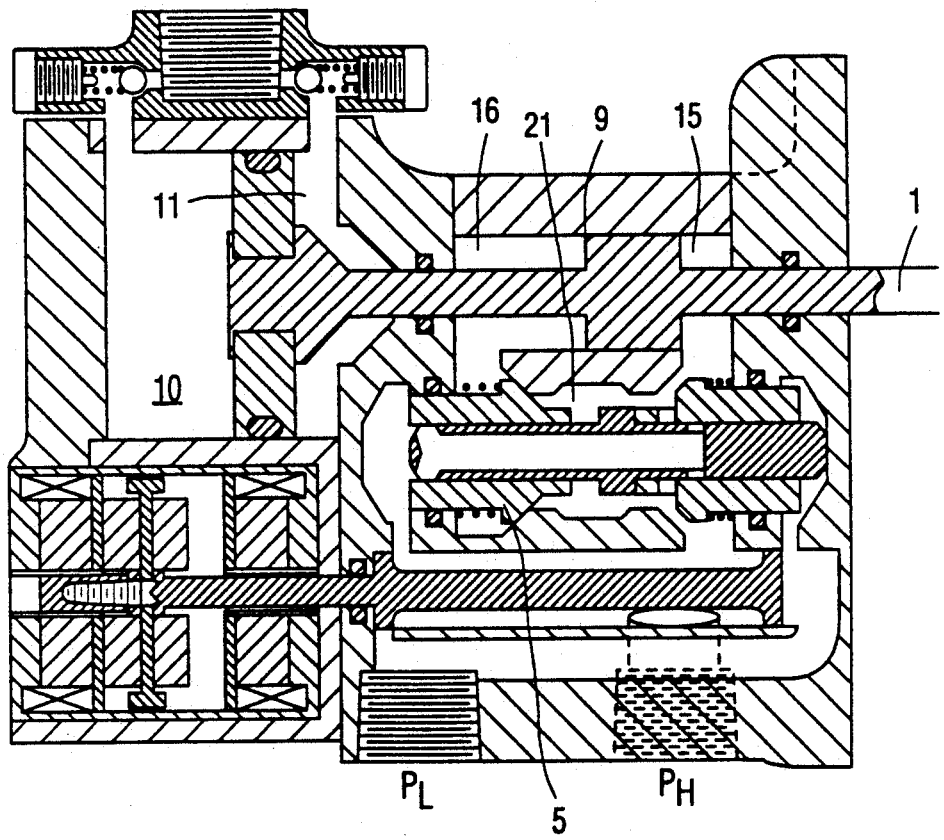
FIG. 4 is a section view of the actuator with the pilot valve and engine valve in their second stable positions.

By the time full opening of the poppet valve occurs, as illustrated in FIG. 4, the bypassing of fluid through passage 21 has ended and the check valve 5 has closed. Also, the momentum of the piston shaft 1 has resulted in compressing the second pneumatic spring in chamber 11 to the highest degree. However, since valve 5 prevents any reverse flow, it will prevent the escape of fluid from chamber 16. This feature provides a means to retain or latch piston 9 in its second stable position (poppet valve fully open), while maintaining a high pneumatic compression force urging the piston 9 back toward its first stable position.

Piston 9 will stay latched in its second stable position until a command is received to force the check valve 5 open and dump the latching fluid.

Figure 5:
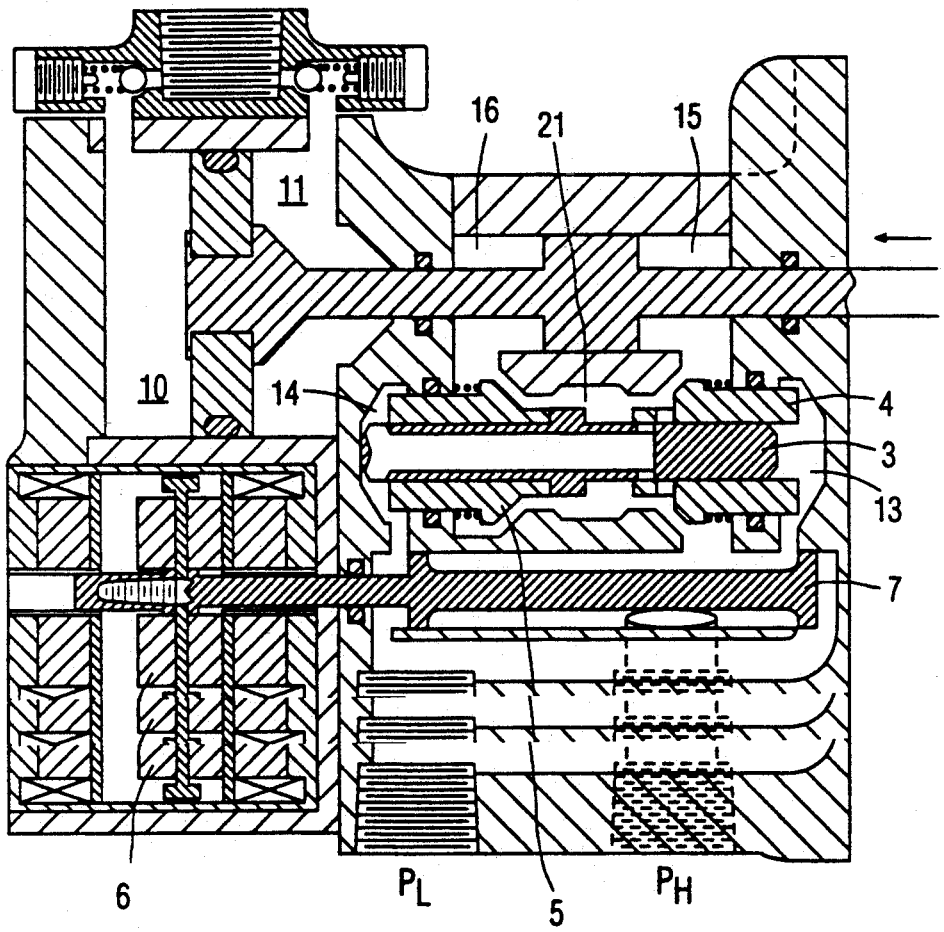
FIG. 5 is a section view of the actuator with the pilot in its first stable position, as the main valve moves toward its second stable position.

FIG. 5 illustrates the conditions during re-closing of the poppet valve. Here the electromagnetic actuator 6 has moved the pilot valve 7 to the right, which valves high pressure fluid from port $P_H$ into chamber 13 and dumps the high pressure in chamber 14 to $P_L$. Carrier 3 responds to this high/low pressure switch by moving to the left, forcing check valve 5 open. Latching fluid is now released from chamber 16 so that high pressure air in chamber 11 is free to power the piston 8 back toward its first position. The released fluid flows back through passage 21 to chamber 15, now forcing check valve 4 to remain open. Since volume conditions are constant, no additional hydraulic energy is required to initiate return of the poppet valve toward its closed position. The return energy is provided solely by the compressed air in chamber 11. However, a degree of mechanical friction and fluid pumping losses will necessitate the requirement to add some additional hydraulic energy at some point along the return path to assure the poppet valve-re-closes and the air in chamber 10 has been recompressed. A method to automatically add this additional energy is disclosed as follows.

Figure 6:
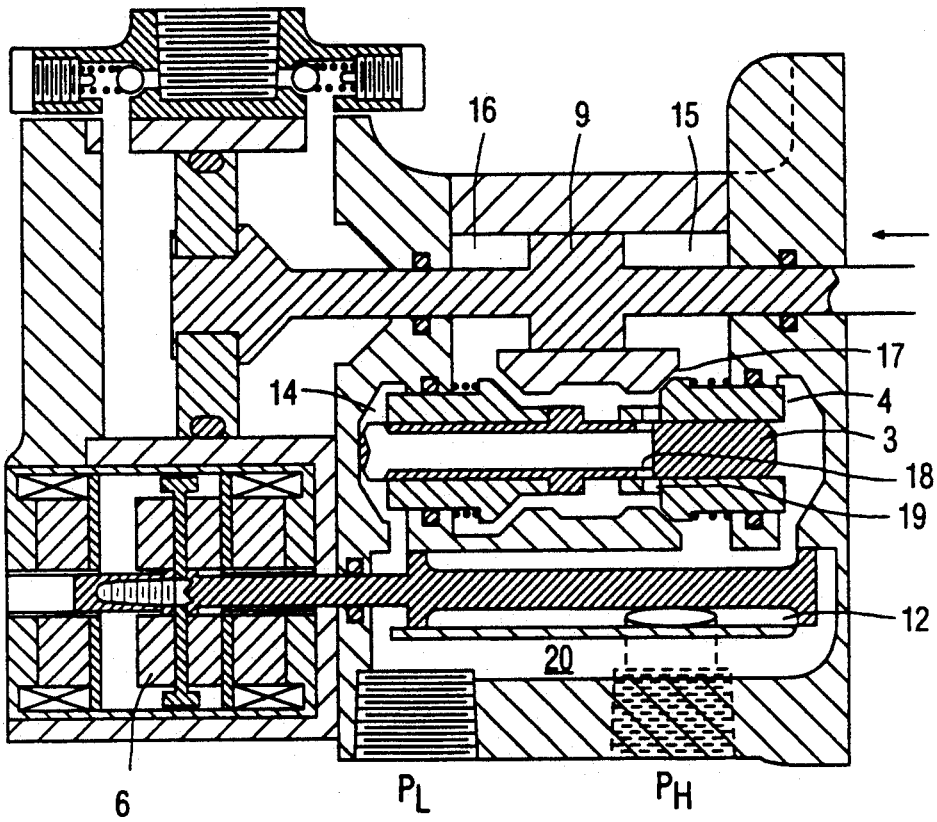
FIG. 6 is a section view of the actuator as the main valve moves toward its second stable position (FIG. 2 follows)

FIG. 6 illustrates that as piston 9 begins to slow down a little (after passing the half way point) the one way valve 4 begins to close due to reduced velocity of fluid traveling between the valve 4 and the seating surface 17. This tendency to close under low velocity conditions is utilized as a velocity sensing means, since the valve 4 will automatically snap shut when the velocity is reduced to a certain value. This characteristic in combination with a feature to port out the fluid trapped in chamber 16 after the sensing valve 4 has closed will provide a means to power the actuator to the closed position.

When carrier 3 is all the way to the left and valve 4 is almost closed, the ports 18 and 19 are aligned to release the fluid from chamber 16 to chamber 14 and low pressure hydraulic chamber 20. When the sensing valve 4 finally snaps shut, all of the energy required to power the hydraulic piston 9 back to its initial position is provided by the hydraulic pump connected to port $P_H$, which pressurizes chamber 15 via chamber 12. Also, as the sensing valve closes, all the fluid in chamber 16 is pumped out to $P_L$ through carrier 3. This design maximizes energy recovery or efficiency, and minimizes the hydraulic energy necessary to power the unit back to its first position. If the losses attributed to friction and pumping can be kept low, the actuator will traverse further toward its first position before hydraulic energy must be added.

FIG. 2 illustrates the pilot valve and poppet valve back in their first stable positions. The final travel has been powered by pure hydraulic energy to assure that the pneumatic spring (air pressure) in chamber 10 has been restored to a high value. FIG. 2 also shows that chamber 16 in front of piston 9 is vented to $P_L$ (low pressure side of the pump) to assure that the high source pressure $P_H$ connected to chamber 15 is providing its maximum holding capacity to keep the pneumatic spring compressed and also provide enough reserve force to keep the poppet valve from leaving its seat due to combustion chamber pressure fluctuations.

Figure 7:
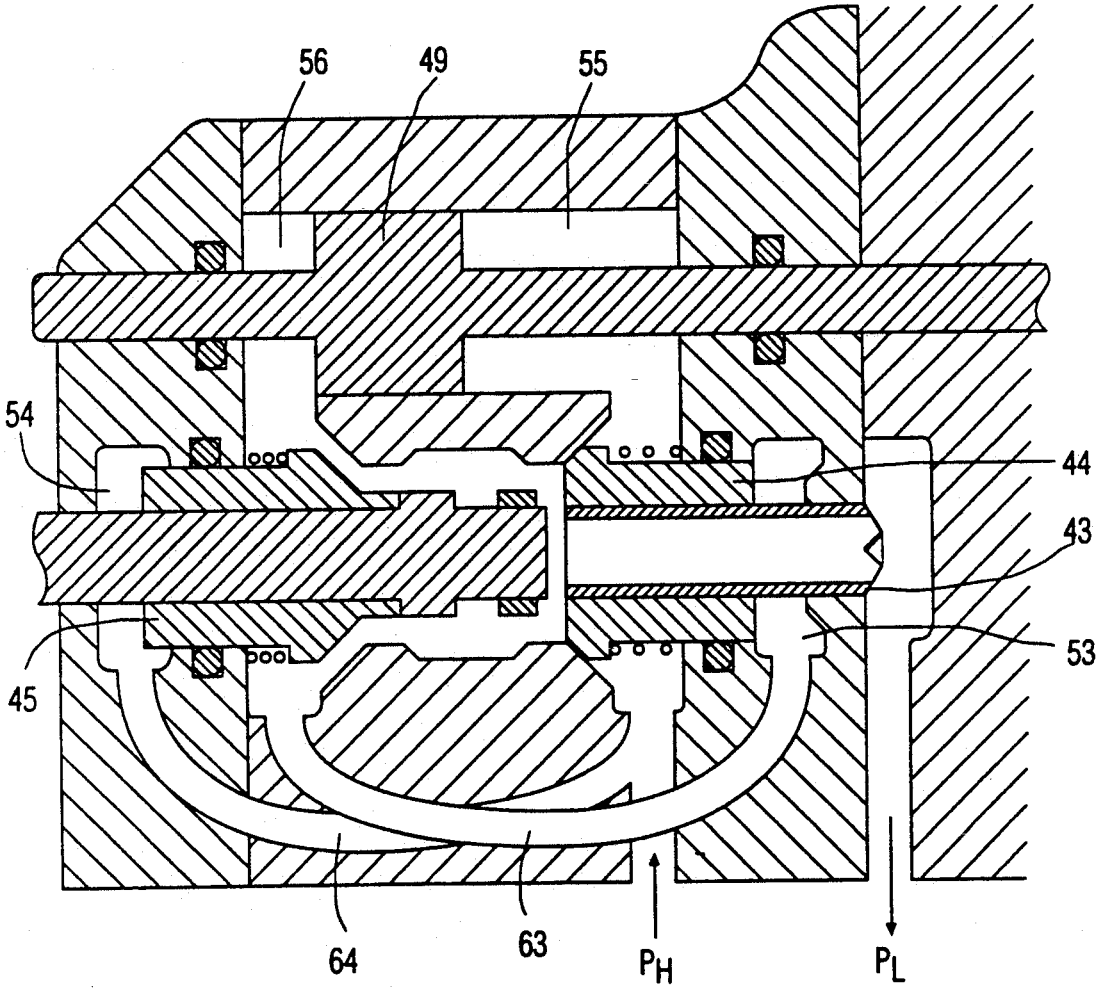
FIG. 7 is a schematic section view of a second embodiment without a pilot valve.

FIG. 7 illustrates a second embodiment wherein the actuator complexity is reduced by directly powering the main valve carrier 43 with the EM actuator. This is accomplished by eliminating the pilot valve and providing cross linking of the pressure from the switching chambers 53 and 54 into working chambers 55 and 56. This cross linking provides a supplementary pressure boost to help the carrier 43 move in the intended direction after the EM actuator receives an initiation signal. Each switching chamber 53, 54 is connected to a respective working chamber 56, 55 by a respective channel 63, 64. $P_H$ always applies direct high pressure fluid into first working chamber 55. Second working chamber 56 is vented to $P_L$ (low sink pressure) whenever the actuator is at rest ready for initiation. Since the first check valve 44 is spring loaded to seat, this pressure combination assures that this valve will be seated prior to initiation.

Figure 8A:
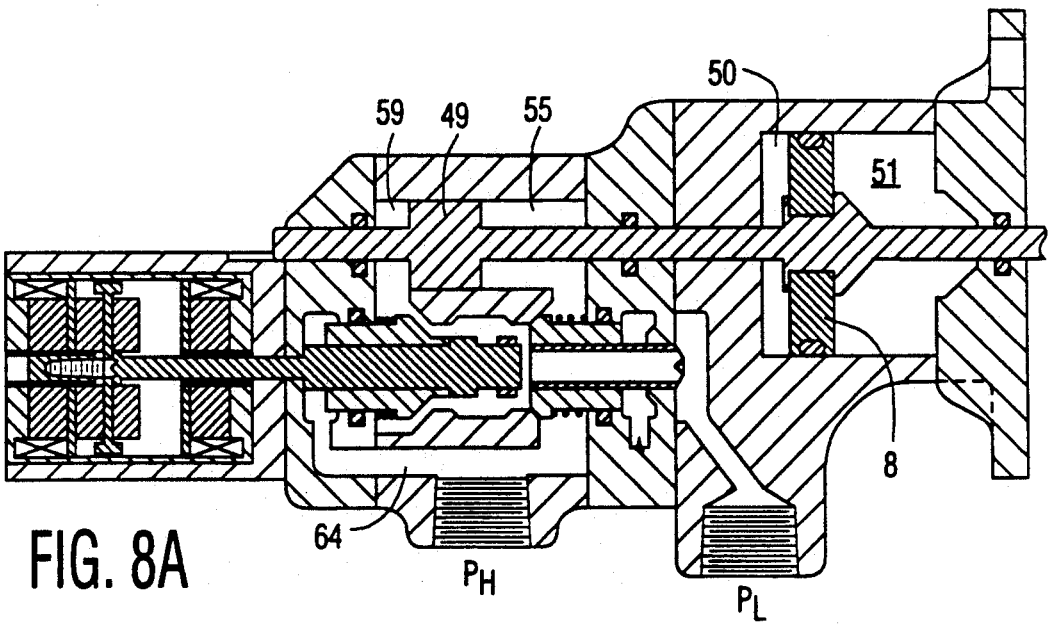
FIGS. 8A and 8B are section views of the second embodiment.
Figure 8B:
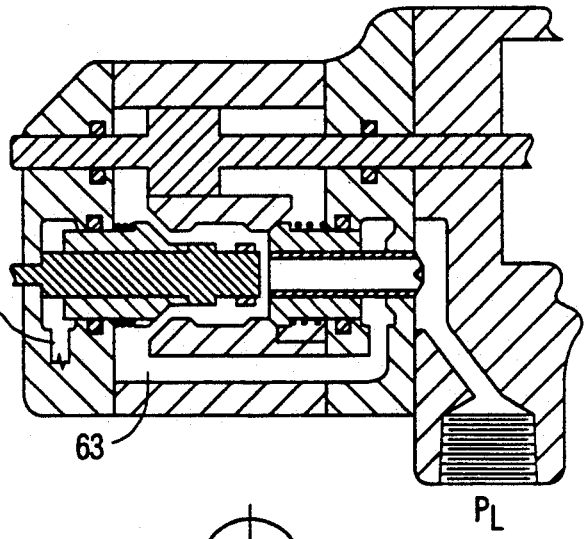
Figure 8C:
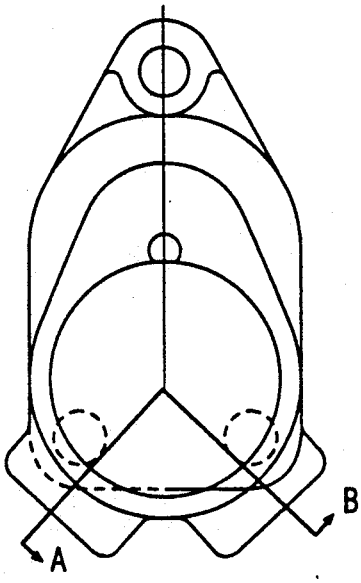
FIG. 8C is an end view of the second embodiment.

Since first working chamber 55 is cross linked to second switching chamber 54, high pressure is applied to both chambers from the high pressure source $P_H$. This causes the high pressure in chamber 54 to apply force on the end of check valve 45. Valve 45 will then transmit this same force against the carrier 43 to urge the carrier 43 to the right. In FIG. 7 the carrier 43 is latched to the left, in its first stable position, so it won't begin moving to the right until the EM actuator receives a release command. Upon release the pressure provided by $P_H$ in chamber 54 powers the second check valve 45 toward the right (second direction) against the carrier 43. After a short distance the carrier 43 will contact and open the first check valve 44. This releasing function is the same as illustrated in FIG. 3; the high pressure fluid in first latching chamber 55 is allowed to bypass through check valves 44 and 45 to the second latching chamber 56. This equalizes the pressure across piston 49, causing it to release the stored energy in pneumatic chamber 50 (FIG. 8A) to propel the poppet valve toward the open or second stable position. When the piston 49 tries to reverse direction (as illustrated in FIG. 4) it accomplishes an added function (besides closing check valve 45 to latch its position) by pressurizing the switching chamber 53 to a magnitude double that in chamber 55. This feature adds supplemental pressure to the end of valve 44. This pressure in turn adds a helping force to carrier 43 and the EM actuator to assist its movement back toward the left (first direction) when it receives a delatching signal. Therefore this embodiment basically functions the same as the initial embodiment except that supplemental pressure is cross fed to each end of switching chamber 53, 54 to help the carrier 43 achieve rapid transit without utilizing an extra pilot valve (amplifier) to do the same thing. FIGS. 8A and 8B illustrate a variation of this embodiment and show how this actuator can take advantage of reversing the location of the pneumatic and hydraulic cylinder assemblies to provide a closer proximity valving arrangement for the hydraulic piston. The cross feed porting is incorporated by two separate channels 63, 64 which are angularly displaced from each other by about 80° referenced in the end view of FIG. 8C.

Figure 9:
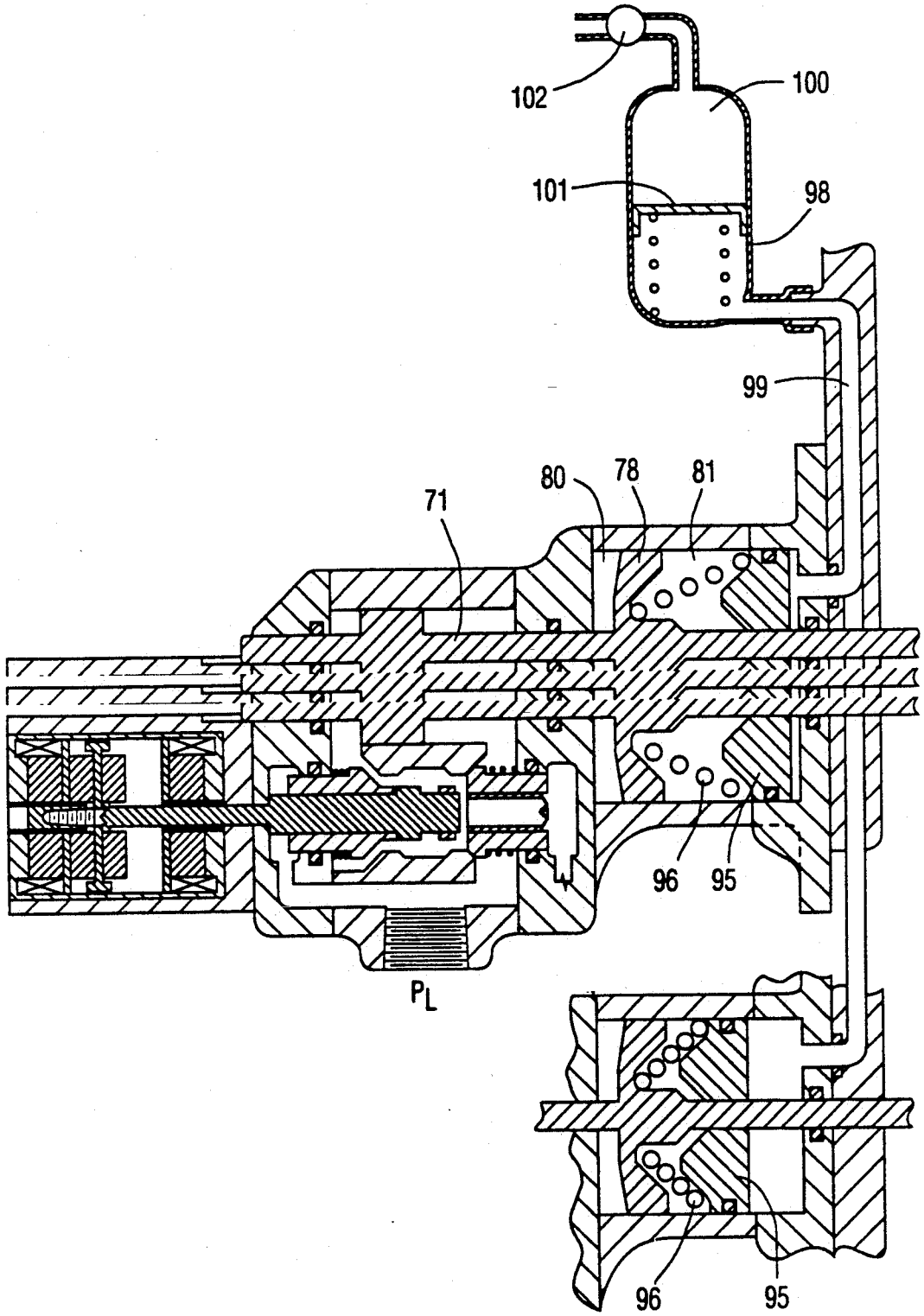
FIG. 9 is a section view of a third embodiment having variable valve lift.

FIG. 9 illustrates a third embodiment with a variable lift capability for the poppet valve. Notice that a positionable piston 95 is incorporated into the pneumatic chamber 81. This piston in combination with a conical helical spring 96 provides a means to capture the pneumatic energy from chamber 80 during the opening of the poppet valve. The first embodiment described chamber 11 as a chamber in which air was compressed to provide a means to return the poppet valve back toward its seat. In this embodiment chamber 81 is not a pneumatic compression chamber but utilizes a spring 96 to provide the return or spring back energy necessary to return the poppet valve. A mechanism is provided to adjust piston 95 in and out by hydraulic pressure in chamber 97. The actuator for an adjacent valve illustrates piston 95 compressing spring 96 by a pressurized fluid in chamber 97. As spring 96 is compressed against the pneumatic piston 78 it provides a means to limit how far the poppet valve will open when the power shaft assembly is released. For example, if spring 96 is compressed against piston 78 until its compression force is equal to 175 lbs., a net opening force of 75 lbs. will occur if the pneumatic force on piston 78 is 250 lbs. when the actuator is released. This will result in a much shorter transit of the power shaft 71 since the movement to compress the spring to its highest magnitude will occur in a much shorter distance. However, the overall transit time will stay about the same since the available force to move the power shaft is only 75 lbs. compared to the maximum available force of 250 lbs. when piston 95 and spring 96 are at their furthest distance from piston 8. The amount of pre-compression force in spring 96 is proportional to the amount of fluid which is pumped into pre-load chamber 97 against piston 95 from an external accumulator 98. All of the pre-load chambers are connected in parallel through a fluid channel 99 in the engine to an accumulator 98. The pressure in chamber 100 of the accumulator is adjusted by the regulator 102. When it becomes necessary to reduce the valve lift, then the regulator 102 will allow an increase of fluid into chamber 100. This in turn will force the moving compliant bulkhead 101 to force more fluid into chamber 97. Since all the compression springs are of equal spring constant, they will be equally compressed against the pneumatic piston. This new position of pistons 95 will result in a shorter valve lift for all valves simultaneously.

Figure 10A:
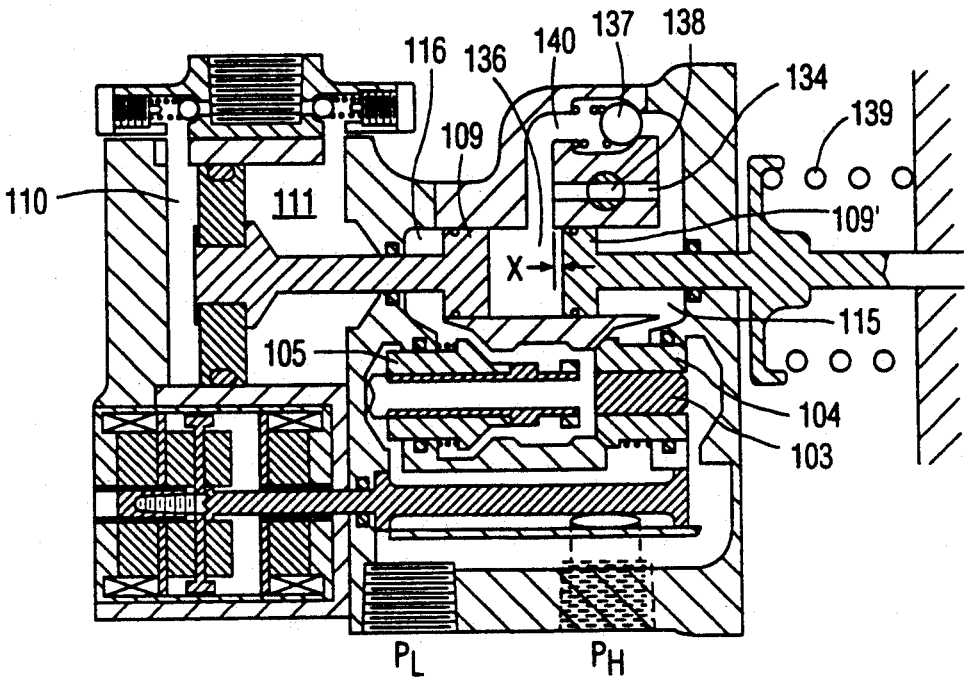
FIG. 10A is a section view of a fourth embodiment having variable valve lift.
Figure 10B:
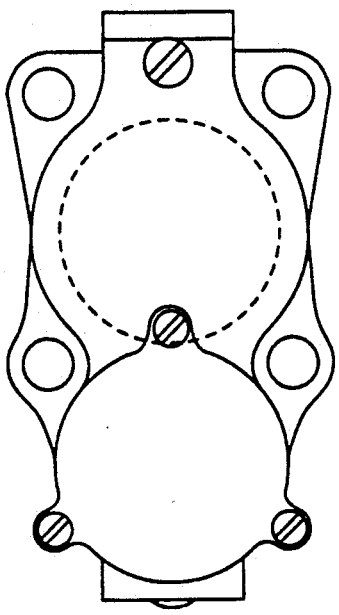
FIG. 10B is an end view of the fourth embodiment.

FIG. 10A illustrates a fourth embodiment, with a second means to provide a changeable lift capability for the poppet valve. This differs from the actuator of the first embodiment in several important respects:

1. The hydraulic piston is now in two parts 109 and 109, with only a column of hydraulic fluid separating them.

2. Two parallel bypass channels between the chamber separating the pistons and the high pressure chamber 115 made up of:

(a) A first channel 134 which contains a simple shut off valve 138 to provide an open channel or closed channel.

(b) A second channel 140 which provides a check valve 137 which allows fluid to only flow into the piston separation chamber 136 from the high pressure chamber 115. This check valve allows the column of hydraulic fluid which separates the two pistons to always reestablish itself after each actuation from the high pressure side.

3. A poppet valve seating spring assembly 139 which assures adequate minimal seating of the poppet valve. One difference between this embodiment and the third embodiment is that this one has only a two position lift feature. However, from an operational standpoint, a short lift of about 0.075 inches and a long lift of about 0.4 inches will cover most of the requirements.

For normal operation in which the poppet valve will open to a high lift, valve 138 is closed. Under this condition the column of hydraulic fluid 136 acts like a solid piston. From an operational standpoint the unit operates exactly like the first embodiment (FIGS. 1-6). However, since the check valve allows the center column 136 to be exposed to the same pressure as the pressure in chamber 115, an additional spring assembly 139 is required to keep the poppet valve firmly seated during its time between activations. With this arrangement the supplementary pressure used to cock the pneumatic spring is provided by the source pressure in chamber 115 being applied to the inner face of piston 109 through check valve 137.

For short lift operation, valve 138 is opened between chambers 136 and 115. As piston 109 is released to travel to the right, the fluid in chamber 136 is bypassed through the open valve 138 into chamber 115 and on through the check valves 104, 105 into chamber 116. As this is happening, piston 109' is held stationary by spring assembly 139 to keep the poppet valve seated. However, as piston 109 is slowing down (due to the compression in chamber 111) it reaches the front edge of port 140. As it reaches this edge the piston 109 has entrapped a column of fluid X distance wide between itself and piston 135. Since this column of fluid has no escape, at this point it becomes part of the two pistons in which the final motion of piston 109 is also transferred to piston 135. This transfer of motion results in the poppet valve opening a small amount associated with the dimension X. The closure of the poppet valve in this short lift mode is accomplished as illustrated for the first embodiment. Once the check valve 105 is opened the fluid latch behind piston 109 is released causing the compressed air in chamber 111 to send the powershaft assembly back to its first position. Note that most of the fluid will flow through the two valves 137 and 138 as the pneumatic spring chamber 110 is reset from the high pressure source acting on piston 109.

Figure 11:
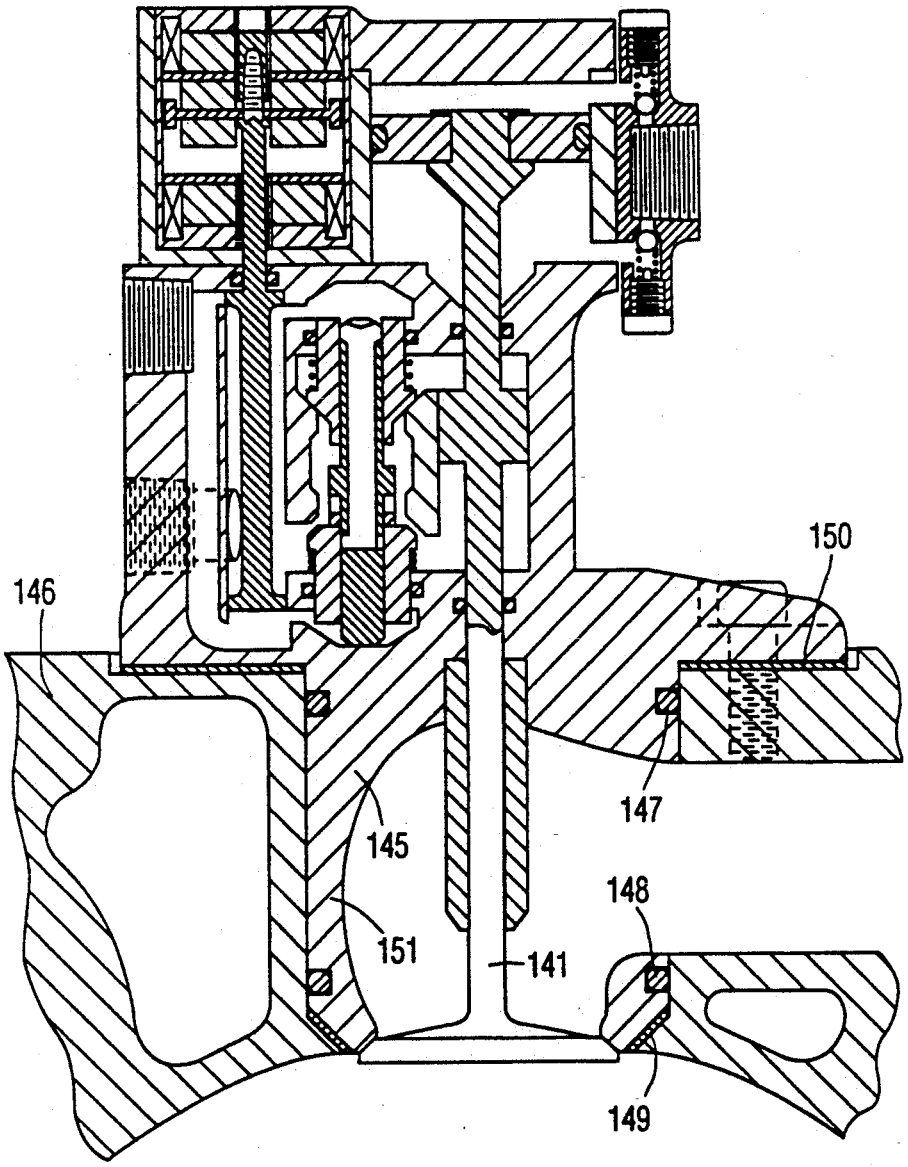
FIG. 11 is a fifth embodiment illustrating a modular actuator.

FIG. 11 illustrates a modular embodiment. Since the actuator and valve do not require a camshaft and can operate as an independent entity, certain advantages can be derived from integrating the entire assembly into a compact plug-in module. The actuator has a cylindrical extension 145 which closely fits into a bore in the head member 146 of an IC engine. The extension is sealed from leakage around its perimeter by two high temperature elastic o-rings 147 and 148. It also contains two ductile high thermal conductivity gaskets 149 and 150 which assure good heat transfer required to relieve the module from thermal stress. Notice that the lower thermal gasket 149 is conical in shape to provide a larger vertical tolerance as it compresses to assure the top thermal gasket 150 can be drawn tight. The lower gasket provides a means to draw heat from the valve head and the top gasket 150 provides a heat conductivity path from the actuator into the water cooled head 146. A coating of ceramic material 151 such as zirconium oxide can be incorporated to reduce the thermal conductivity effects of the hot exhaust gasses on the inside surface of the module.

The foregoing is exemplary and not intended to limit the scope of the claims which follows.

We claim:

1. A bistable actuator mechanism comprising a pneumatic piston translatable in opposed first and second directions toward respective first and second stable positions, a first pneumatic chamber for compressing air as said piston translates in said first direction, thereby providing a spring force in said second direction, a second pneumatic chamber for compressing air as said piston translates in said second direction, thereby providing a spring force in said first direction, hydraulic power means for urging said pneumatic piston to said first stable position against said spring force in said second direction.

2. A mechanism as in claim 1 wherein said hydraulic power means comprises a first source of hydraulic fluid under pressure, a hydraulic piston on a common shaft with said pneumatic piston, whereby said hydraulic piston is translatable in said first and second directions, and a first hydraulic chamber connected to said first source of hydraulic fluid for urging said hydraulic piston in said first direction.

3. A mechanism as in claim 2 further comprising a second hydraulic chamber which receives hydraulic fluid as said hydraulic piston translates in said second direction, and transfer means for transferring hydraulic fluid from said second chamber to said first chamber as said hydraulic piston translates in said first direction, and for transferring hydraulic fluid from said first chamber to said second chamber as said hydraulic piston translates in said second direction.

4. A mechanism as in claim 3 wherein said transfer means comprises a first check valve which is held open by moving fluid as said hydraulic piston moves in said first direction, said first check valve closing when said hydraulic piston reaches said first stable position, means for holding said first check valve open when said hydraulic piston moves in said second direction and in said second stable position, a second check valve which is held open by moving fluid as said hydraulic piston moves in said second direction, said second check valve closing when said hydraulic piston reaches said second stable position, and means for holding said second check valve open when said hydraulic piston moves in said first direction and in said first stable position.

5. A mechanism as in claim 4 wherein said means for holding said first and second check valves open comprises a carrier translatable between first and second stable positions, said first and second check valves being mounted for sliding movement on said carrier, said first check valve being held open by said carrier when said carrier is in said second stable position, said second check valve being held open by said carrier when said carrier is in said first stable position.

6. Mechanism as in claim 5 further comprising means for causing reciprocation of said carrier between said first and second stable positions on command.

7. Mechanism as in claim 6 wherein said means for causing reciprocation comprises an armature on a common shaft with said carrier, and first and second magnetic means defining an air gap therebetween, said armature being reciprocable on command between said first and second magnetic means.

8. Mechanism as in claim 6 wherein said means for causing reciprocation of said carrier comprises a pilot valve reciprocable between first and second stable positions on command, said pilot valve in its first stable position channeling fluid from said first source of hydraulic fluid to said carrier so that said carrier is shifted to its first stable position, said pilot valve in its second stable position channeling fluid from said first source of hydraulic fluid to said carrier so that said carrier is shifted to its second stable position.

9. Mechanism as in claim 2 further comprising a second hydraulic chamber which receives hydraulic fluid as said hydraulic piston translates in said second direction, and a check valve which admits hydraulic fluid from said first hydraulic chamber to said second hydraulic chamber as said hydraulic piston travels in said second direction, said check valve closing to isolate said second hydraulic chamber when said hydraulic piston reaches said second stable position, thereby latching said hydraulic piston in said second stable position.

10. Mechanism as in claim 9 further comprising means for opening said check valve in order to unlatch said hydraulic piston and trigger movement in said first direction.

11. Mechanism as in claim 10 wherein said means for opening said check valve comprises a carrier reciprocable between first and second positions on command, said check valve being mounted on said carrier.

12. Mechanism as in claim 9 further comprising a switching chamber which is hydraulically connected to said first hydraulic chamber, said switching chamber providing hydraulic pressure which urges said check valve closed.

13. Mechanism as in claim 2 further comprising a second hydraulic chamber which receives hydraulic fluid as said hydraulic piston translates in said second direction, and a check valve which admits hydraulic fluid from said second hydraulic chamber to said first hydraulic as said hydraulic piston travels in said first direction, said check valve closing when said hydraulic piston reaches said first stable position.

14. Mechanism as in claim 13 further comprising a second source of hydraulic fluid under pressure which is less than the pressure of hydraulic fluid from said first source, and means connecting said second hydraulic chamber to said second source of hydraulic fluid when said check valve closes.

15. Mechanism as in claim 14 wherein said means connecting said second hydraulic chamber to said second source of hydraulic fluid comprises a carrier on which said check valve is mounted, said carrier having a port which is connected through said carrier to said second source of hydraulic fluid, said port being exposed to receive hydraulic fluid from said second chamber only when said check valve is closed.

16. Mechanism as in claim 14 further comprising a switching chamber which is hydraulically connected to said second hydraulic chamber, said switching chamber providing hydraulic pressure which urges said check valve closed.

17. Mechanism as in claim further comprising means for controlling the volume of at least one of said first and second pneumatic chambers, thereby controlling the amount of translation of said pneumatic piston.

18. Mechanism as in claim i further comprising a first hydraulic piston part on a common shaft with said pneumatic piston, a first source of hydraulic fluid under pressure, a first hydraulic chamber connected to said first source of hydraulic fluid under pressure, a second hydraulic piston part facing said first hydraulic chamber so that said first source of hydraulic fluid can urge said second hydraulic piston in said first direction, said second hydraulic piston part being separated from said first hydraulic piston part by a column of hydraulic fluid translatable in said first and second directions in a separation chamber, a first bypass channel connecting said separation chamber to said first hydraulic chamber, said first channel having a shutoff valve therein, a second bypass channel connecting said separation chamber to said first hydraulic chamber, said second channel having a check valve which only allows fluid to flow from the first hydraulic chamber to the piston separation chamber.

19. Mechanism as in claim 18 further comprising spring means urging said second piston part in said first direction.

20. Mechanism as in claim 1 further comprising an engine valve on a common shaft with said pneumatic piston, a housing for said pneumatic piston and said shaft, said housing having an extension with a seat for said engine valve, said extension being configured for reception in a receptacle of an internal combustion engine to close a combustion chamber.

* * * * *